US008011750B2

(12) United States Patent
Kuk et al.

(10) Patent No.: US 8,011,750 B2
(45) Date of Patent: Sep. 6, 2011

(54) METHOD AND APPARATUS FOR DETECTING MISSING NOZZLE IN THERMAL INKJET PRINTHEAD

(75) Inventors: Keon Kuk, Yongin-si (KR); Bang-weon Lee, Yongin-si (KR); Seong-taek Lim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 847 days.

(21) Appl. No.: 12/046,503

(22) Filed: Mar. 12, 2008

(65) Prior Publication Data

US 2009/0135221 A1 May 28, 2009

(30) Foreign Application Priority Data

Nov. 27, 2007 (KR) ..... 10-2007-0121411

(51) Int. Cl.
*B41J 29/393* (2006.01)

(52) U.S. Cl. ..... 347/19; 347/5; 347/17

(58) Field of Classification Search ..... None
See application file for complete search history.

(56) References Cited

U.S. PATENT DOCUMENTS 5,182,580 A * 1/1993 Ikeda et al. ..... 347/19

* cited by examiner

*Primary Examiner* — Uyen Chau N Le
*Assistant Examiner* — Chad Smith
(74) *Attorney, Agent, or Firm* — Stanzione & Kim, LLP

(57) ABSTRACT

Provided is a method of detecting a missing nozzle in a thermal inkjet printhead. The method includes: applying an input energy high enough to eject ink to a heater corresponding to a target nozzle, and applying an input energy not high enough to eject ink to a heater corresponding to a nozzle adjacent to the target nozzle; when a predetermined time passes, detecting a difference between temperatures which are measured at points spaced by a predetermined distance from each of the two heaters; and determining whether the target nozzle is missing.

8 Claims, 7 Drawing Sheets

METHOD AND APPARATUS FOR DETECTING MISSING NOZZLE IN THERMAL INKJET PRINTHEAD

CROSS-REFERENCE TO RELATED APPLICATIONS

This application claims the benefit of Korean Patent Application No. 10-2007-0121411, filed on Nov. 27, 2007, in the Korean Intellectual Property Office, the disclosure of which is incorporated herein in its entirety by reference.

BACKGROUND OF THE INVENTION

1. Field of the Invention

The present invention relates to a method and apparatus for detecting a missing nozzle in an inkjet printhead, and more particularly, to a method and apparatus for detecting a missing nozzle in a thermal inkjet printhead.

2. Description of the Related Art

In general, inkjet printheads are devices that eject ink droplets onto desired positions of a recording medium to form an image of a predetermined color. Inkjet printheads are categorized into two types according to the ink ejection mechanism thereof. The first one is a thermal inkjet printhead that ejects ink droplets due to an expansion force of bubbles generated in ink by thermal energy. The other one is a piezoelectric inkjet printhead that ejects ink droplets due to pressure applied to ink due to deformation of a piezoelectric body.

An ink droplet ejection mechanism of a thermal inkjet printhead will now be explained in detail. When a pulse current is supplied to a heater including a heating resistor, the heater generates heat and ink near the heater is instantaneously heated up to approximately 300° C., thereby boiling the ink. Accordingly, ink bubbles are generated by ink evaporation, and the generated bubbles are expanded to exert pressure on the ink filled in an ink chamber. As a result, ink around a nozzle is ejected from the ink chamber in the form of droplets through the nozzle.

When the thermal inkjet printhead has a nozzle that leads to poor ink ejection, streak lines are shown in a printed image, thereby degrading print quality. Accordingly, when there is a missing nozzle, the thermal inkjet printhead should prevent print quality degradation by compensating for the missing nozzle with a normal nozzle. To this end, a method of detecting a missing nozzle by monitoring whether ink is normally ejected through nozzles of the thermal inkjet printhead is necessary.

SUMMARY OF THE INVENTION

The present invention provides a method and apparatus for detecting a missing nozzle in a thermal inkjet printhead.

According to an aspect of the present invention, there is provided a method of detecting a missing nozzle in a thermal inkjet printhead, the method comprising: applying an input energy high enough to eject ink to a heater corresponding to a target nozzle, and applying an input energy not high enough to eject ink to a heater corresponding to a nozzle adjacent to the target nozzle; when a predetermined time passes, detecting a difference between temperatures which are measured at points spaced by a predetermined distance from each of the two heaters; and determining whether the target nozzle is missing.

Whether the target nozzle is missing may be determined by using the detected temperature difference. Whether target nozzle is missing may be determined by using a temperature change rate difference calculated by using the detected temperature difference.

According to another aspect of the present invention, there is provided a method of detecting a missing nozzle in a thermal inkjet printhead, the method comprising: selecting first and second heaters adjacent to each other among heaters of the inkjet printhead; applying a first input energy high enough to eject ink to the first heater and applying a second input energy not high enough to eject ink to the second heater; when a predetermined time passes, detecting a difference between temperatures which are measured at points spaced by a predetermined distance from each of the first and second heaters; and determining whether the first heater is missing.

The second input energy may be approximately 30% of the first input energy.

When a predetermined time passes after the determining of whether the first heater is missing, the method may further comprise: applying the second input energy to the first heater and applying the first input energy to the second heater; when a predetermined time passes, detecting a difference between temperatures which are measured at points spaced by a predetermined distance from each of the first and second heaters; and determining whether the second heater is missing.

According to another aspect of the present invention, there is provided an apparatus for detecting a missing nozzle among nozzles of a thermal inkjet printhead, the apparatus comprising: a plurality of temperature measuring elements corresponding to heaters of the inkjet printhead and spaced by predetermined distances respectively from the heaters; a multiplexer selecting and outputting temperatures measured by two temperature measuring elements corresponding to the adjacent heaters from among the heaters; a differential amplifier amplifying a difference between the temperatures output from the multiplexer; and an analogue-to-digital (A/D) converter connected to an output end of the differential amplifier.

The apparatus may further comprise a differential circuit disposed between the differential amplifier and the A/D converter and calculating a temperature change rate difference by using the amplified temperature difference output from the differential amplifier.

The temperature measuring elements may be metal thermometers or thermocouple thermometers.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
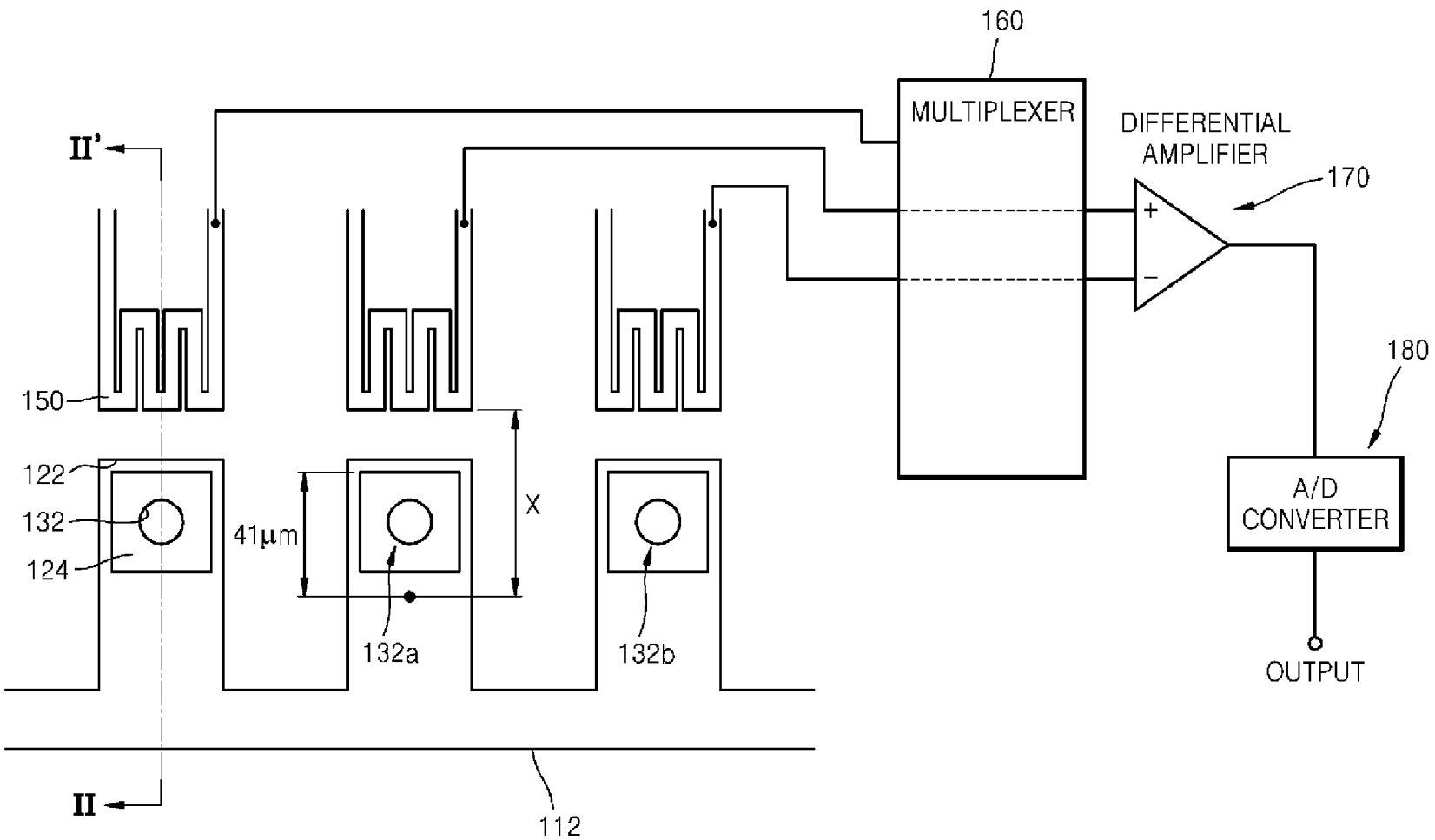
FIG. 1 is a schematic view of an apparatus for detecting a missing nozzle in a thermal inkjet printhead according to an embodiment of the present invention.

The present invention will now be described more fully with reference to the accompanying drawings, in which exemplary embodiments of the invention are shown. In the drawings, the same reference numeral denote the same elements and the sizes or thicknesses of elements may be exaggerated for clarity.

Figure 2:
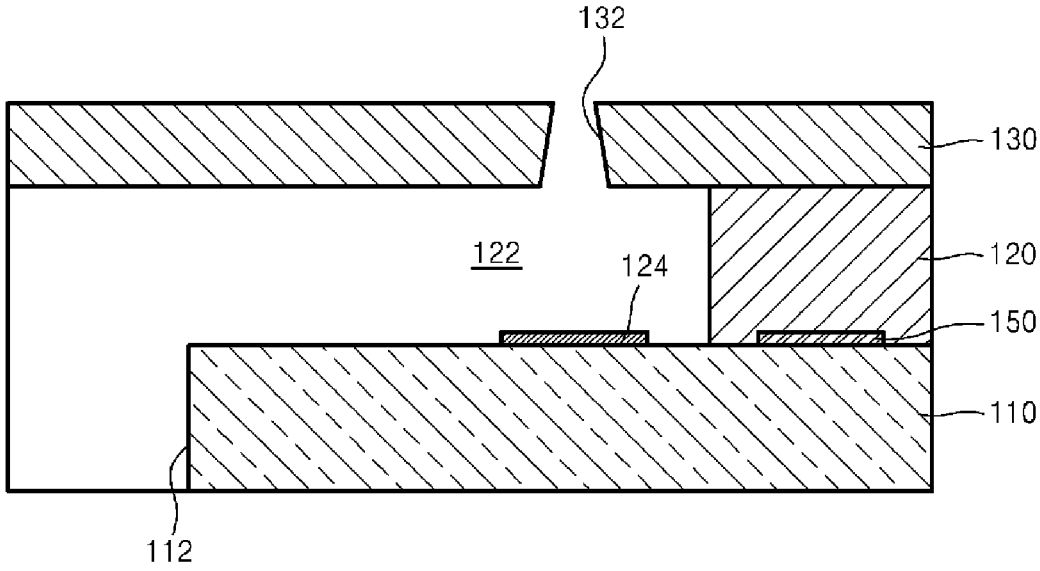
FIG. 2 is a cross-sectional view taken along line II-II' of FIG. 1.

FIG. 1 is a schematic view of an apparatus for detecting a missing nozzle in an inkjet printhead according to an embodiment of the present invention. FIG. 2 is a cross-sectional view taken along line II-II' of FIG. 1.

Referring to FIGS. 1 and 2, a chamber layer 120 and a nozzle layer 130 are sequentially stacked on a substrate 110. A plurality of ink chambers 122 in which ink to be ejected is filled are formed in the chamber layer 120. A plurality of nozzles 132 through which ink is ejected are formed in the nozzle layer 130. Ink feed holes 112 through which ink is supplied to the ink chambers 122 are formed in the substrate 110. A plurality of heaters 124 for generating bubbles by heating the ink filled in the ink chambers 112 are formed on bottom surfaces of the ink chambers 122. Although not shown, a plurality of electrodes for supplying electric current to the heaters 124 are formed on the heaters 124.

A plurality of temperature measuring elements 150 are formed on the substrate 110 to be spaced by predetermined distances from the heaters 124. The temperature measuring elements 150 may be formed on the same plane as the heaters 124. The temperature measuring elements 150 correspond to the heaters 124 and measure temperatures at points spaced by predetermined distances respectively from the heaters 124. The temperature measuring elements 150 may be thermocouple thermometers or metal thermometers using a resistance change. However, the present invention is not limited thereto. In FIG. 1, X denotes a distance between an arbitrary reference point in an ink chamber 122 and a temperature measuring element 150.

Temperatures measured by the temperature measuring elements 150 are input to a multiplexer 160. The multiplexer 160 selects temperatures of adjacent heaters 124 measured by two temperature measuring elements 150 corresponding to the adjacent heaters 124 from among the heaters 124 and outputs the selected temperatures to a differential amplifier 170. The differential amplifier 170 amplifies a difference between the temperatures measured by the two temperature measuring elements 150 corresponding to the adjacent heaters 124 output from the multiplexer 160 and outputs the amplified temperature difference to an analogue-to-digital (A/D) converter 180. In this process, since noises of the temperature measuring elements 150 are removed by the differential amplifier 170, an accurate temperature difference can be detected. The amplified temperature difference output to an analogue-to-digital (A/D) converter 180 is converted into a digital signal.

A method of detecting a missing nozzle performed by the apparatus constructed as described above according to an embodiment of the present invention will now be explained. First, a normal input energy high enough to eject ink is applied to a heater 124 corresponding to a target nozzle 132*a* whose operation is to be measured, and an energy lower than the normal input energy, that is, an energy not high enough to eject ink, is applied to a heater 124 corresponding to a reference nozzle 132*b* adjacent to the target nozzle 132*a*. For example, the energy applied to the heater 124 corresponding to the reference nozzle 132*b* may be approximately 30% of the normal input energy. Next, temperatures measured by temperature measuring elements 150 corresponding to the heaters 124 are output to the multiplexer 160, and a difference between the temperatures measured by the temperature measuring elements 150 is detected by the differential amplifier 170 and the A/D converter 180. The difference between the temperatures of the target nozzle 132*a* and the reference nozzle 132*b* may depend on whether the target nozzle 132*a* is a normal nozzle or a dead nozzle. That is, a temperature of a normal nozzle is lower than a temperature of a dead nozzle because of cooling effect of droplets ejected through the normal nozzle. Accordingly, a temperature difference between a normal nozzle and the reference nozzle 132*b* is smaller than a temperature difference between a dead nozzle and the reference nozzle 132*b*. Accordingly, once the temperature difference between the target nozzle 132*a* and the reference nozzle 132*b* is measured, whether the target nozzle 132*a* is a normal nozzle or a dead nozzle can be detected. When the aforementioned process is repeated on other remaining nozzles 132, all the nozzles 132 of the inkjet printhead can be checked.

Temperature versus measurement distance and temperature versus time for a normal nozzle and a dead nozzle will now be explained with reference to FIGS. 3 and 4.

Figure 3:
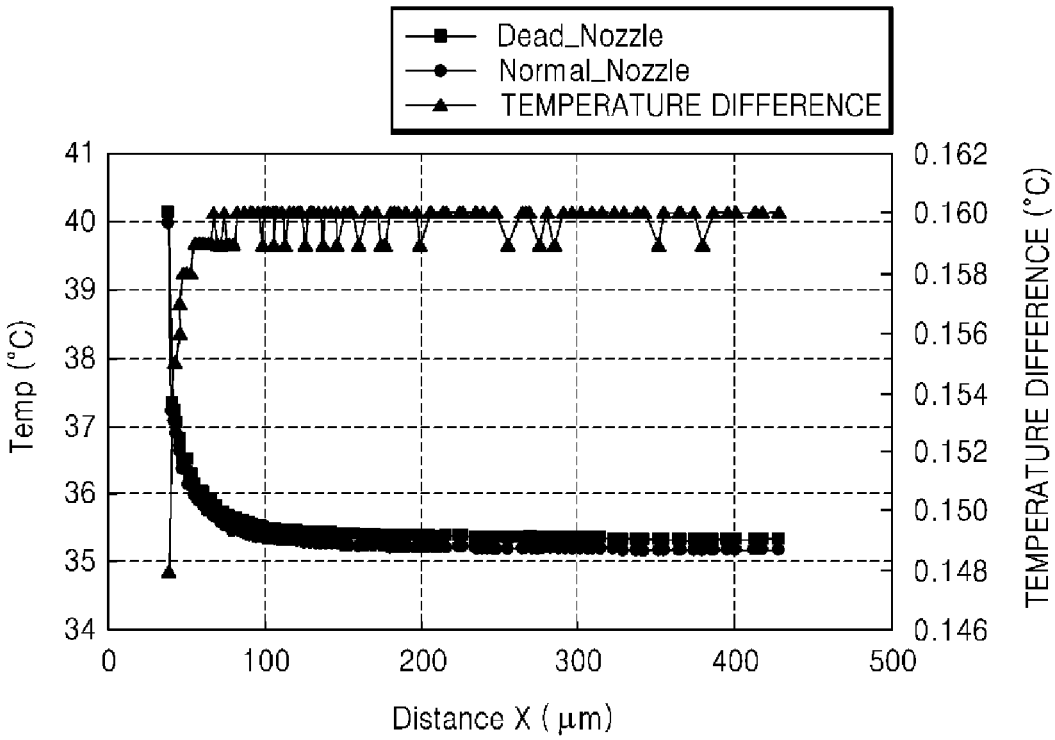
FIG. 3 is a graph illustrating temperature and temperature difference versus measurement distance for a normal nozzle and a dead nozzle.

FIG. 3 is a graph illustrating temperature and temperature difference versus measurement distance X for a normal nozzle and a dead nozzle. Results of FIG. 3 were calculated by using heat transfer analysis considering ink flow. A temperature difference marked by ▲ was obtained by subtracting a temperature of the normal nozzle from a temperature of the dead nozzle. The same input energy of 1.2 μJ was applied to heaters 124. An in ejection frequency was 6 kHz. A measurement was conducted 0.5 seconds after ink ejection. A measurement distance X was a distance between an arbitrary reference point in an ink chamber 122 and a temperature measuring element 150. Referring to FIG. 3, as the measurement distance X increases, the temperatures of both the normal nozzle and the dead nozzle drastically decrease. When the measurement distance X exceeds approximately 100 μm, a maximum temperature difference between the normal nozzle and the dead nozzle is 0.16° C.

Figure 4:
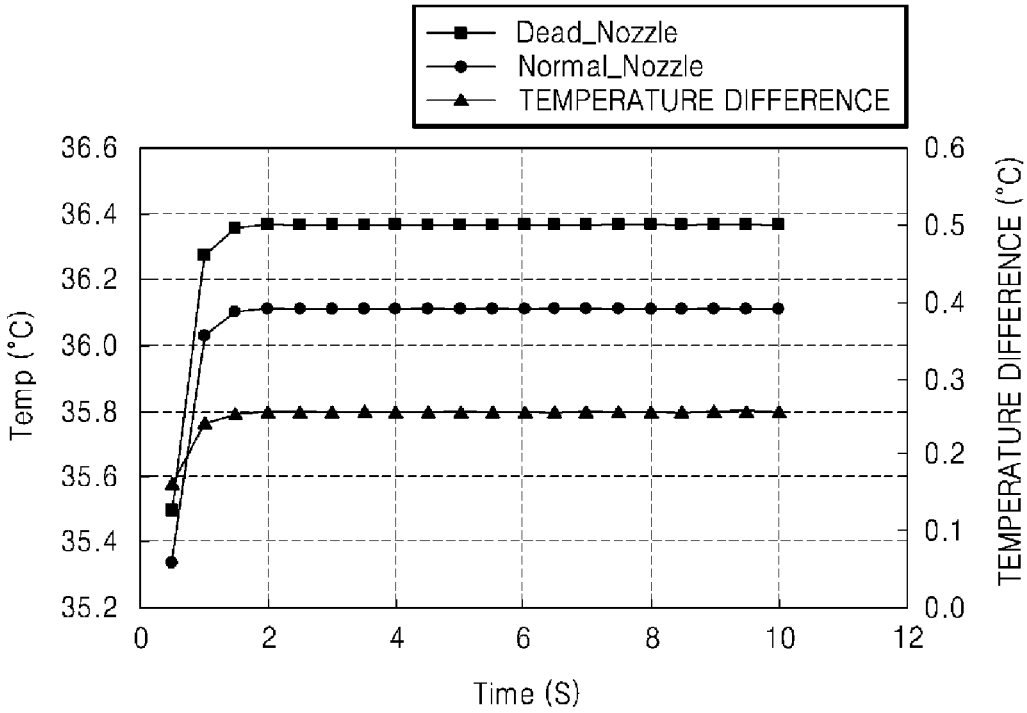
FIG. 4 is a graph illustrating temperature and temperature difference versus for a normal nozzle and a dead nozzle when a measurement distance is 100 μm.

FIG. 4 is a graph illustrating temperature and temperature difference versus time for a normal nozzle and a dead nozzle when a measurement distance X is 100 μm. In FIG. 4, a temperature difference marked by ▲ was obtained by subtracting a temperature of the normal nozzle from a temperature of the dead nozzle. The same input energy of 1.2 μJ was applied to heaters 124. An ink ejection frequency was 6 kHz. Referring to FIG. 4, when 2 seconds pass after ink ejection, the temperatures of both the normal nozzle and the dead nozzle rise to maximum levels, and since then, are not changed. A temperature difference between the normal nozzle and the dead nozzle is approximately 0.25° C.

Figure 5:
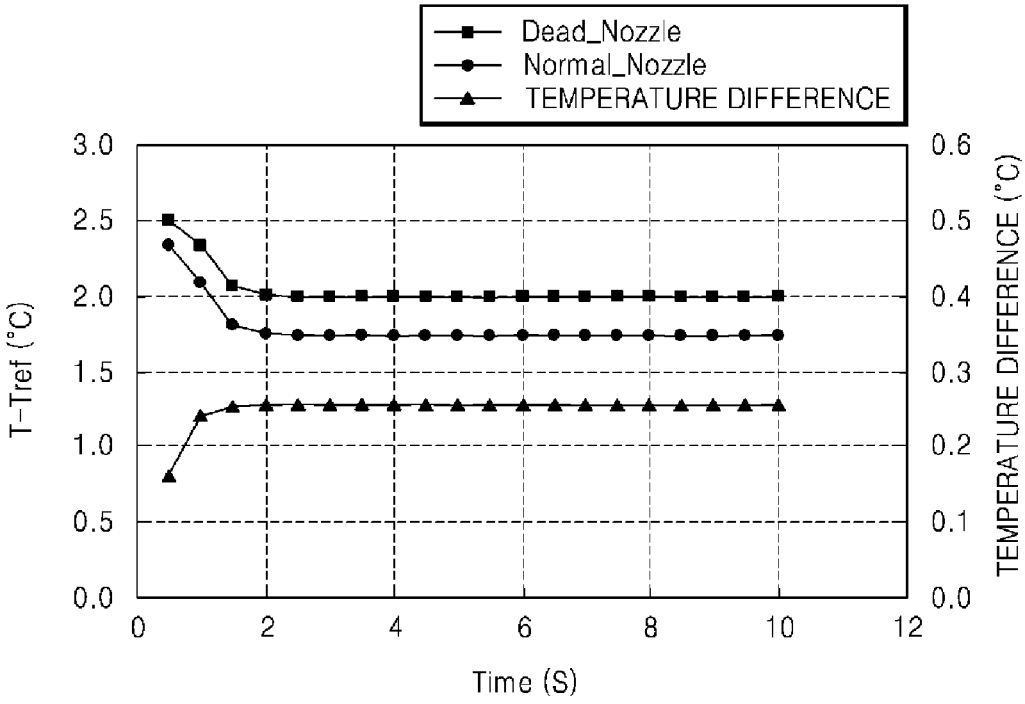
FIG. 5 is a graph illustrating temperature differences between a normal nozzle and a reference nozzle and between a dead nozzle and a reference nozzle over time using the apparatus of FIG. 1.

FIG. 5 is a graph illustrating temperature differences between a normal nozzle and a reference nozzle 132*b* and between a dead nozzle and the reference nozzle 132*b* over time when a measurement distance X is 100 μm using the apparatus of FIG. 1. In FIG. 5, a temperature difference marked by ▲ was obtained by subtracting a temperature difference between the normal nozzle and the reference nozzle 132*b* from a temperature difference between the dead nozzle and the reference nozzle 132*b*, that is, by subtracting a temperature of the normal nozzle from a temperature of the dead nozzle. An input energy applied to a heater 124 corresponding to the target nozzle 132*a* was 1.2 μJ and an ejection frequency was 6 kHz. An input energy applied to a heater 124 corresponding to the reference nozzle 132*b* was 30% of the input energy applied to the target nozzle 132*a*.

Since the input energy applied to the reference nozzle 132*b* is lower than the input energy applied to the target nozzle 132*a*, a temperature of the reference nozzle 132*b* is lower than a temperature of the target nozzle 132*a*. When 2 seconds pass after ink ejection, the temperature of the reference nozzle 132*b* reaches approximately 34.4° C. Accordingly, as shown in FIG. 5, when the target nozzle 132*a* is a normal nozzle, a temperature difference $T_{normal}-T_{ref}$ between the normal nozzle and the reference nozzle 132*b* is approximately 1.75° C., and when the target nozzle 132*a* is a dead nozzle, a temperature difference $T_{dead}-T_{ref}$ between the dead nozzle and the reference nozzle 132*b* is approximately 2° C.

Whether the target nozzle 132*a* is missing can be determined from the results of FIG. 5. In detail, when a temperature difference $T-T_{ref}$ between the target nozzle 132*a* and the reference nozzle 132*b* is a negative number, it is inferred that no electric current is applied to the heater 124 corresponding to the target nozzle 132*a*, and thus the target nozzle 132*a* is a missing nozzle due to electrical short circuit. When the temperature difference $T-T_{ref}$ between the target nozzle 132*a* and the reference nozzle 132*b* is greater than 2° C., it is inferred that an input energy is applied to the heater 124 corresponding to the target nozzle 132*a*, but the target nozzle 132*a* is a dead nozzle not ejecting ink. When the temperature difference $T-T_{ref}$ between the target nozzle 132*a* and the reference nozzle 132*b* is less than 1.75° C., it is inferred that the target nozzle 132*a* is a normal nozzle ejecting ink droplets each having a normal size. When the temperature difference $T-T_{ref}$ between the target nozzle 132*a* and the reference nozzle 132*b* ranges from 1.75° C. to 2° C., it is inferred that the target nozzle 132*a* ejects ink droplets each having a size less than the normal size.

If a temperature measuring element 150 is a metal thermometer using a resistance change, whether the target nozzle 132*a* is missing may be determined by using a resistance difference caused by a temperature difference between the target nozzle 132*a* and the reference nozzle 132*b* as described below.

When the temperature measuring element 150 is a metal thermometer using a resistance change, a resistance according to temperature is expressed by $$R=\alpha\times R_0\times(T-T_0)+R_0 \quad (1)$$

where R denotes a resistance, α denotes a temperature coefficient of resistance, and $R_0$ denotes a resistance at a standard temperature, and $T_0$ denotes the standard temperature.

Since a distance between the target nozzle 132*a* and the reference nozzle 132*b* which are adjacent to each other in the thermal inkjet printhead is so small, for example, approximately 43 μm, it can be assumed that the temperature coefficients of resistance α and the resistances at the standard temperature $R_0$ for the adjacent target nozzle 132*a* and reference nozzle 132*b* are the same.

Accordingly, a resistance change between the target nozzle 132*a* and the reference nozzle 132*b* can be expressed by $$R-R_{ref}=\alpha\times R_0\times(T-T_{ref}) \quad (2)$$

where $R_{ref}$ denotes a resistance of the reference nozzle 132*b*.

A resistance difference $R_{normal}-R_{ref}$ between the normal nozzle and the reference nozzle 132*b* and a resistance difference $R_{dead}-R_{ref}$ between the dead nozzle and the reference nozzle 132*b*, which are calculated by using an aluminum thermometer with $R_0$ of 10 kΩ and a of 0.004403/° C. from the results of FIG. 5, are approximately 77Ω and approximately 88Ω, respectively.

Whether the target nozzle 132*a* is missing can be determined from the results. In detail, when a resistance difference $R-R_{ref}$ between the target nozzle 132*a* and the reference nozzle 132*b* is a negative number, it is inferred that no input energy is applied to the target nozzle 132*a* and thus the target nozzle 132*a* is a missing nozzle due to electrical short circuit. When the resistance difference $R-R_{ref}$ between the target nozzle 132*a* and the reference nozzle 132*b* is greater than 88Ω, it is inferred that an input energy is applied to the target nozzle 132*a* but the target nozzle 132*a* is a dead nozzle not ejecting ink. When the resistance difference $R-R_{ref}$ between the target nozzle 132*a* and the reference nozzle 132*b* is less than 77Ω, it is inferred that the target nozzle 132*a* is a normal nozzle ejecting ink droplets each having a normal size. When the resistance difference $R-R_{ref}$ between the target nozzle 132*a* and the reference nozzle 132*b* ranges from 77Ω to 88Ω, it is inferred that the target nozzle 132*a* ejects ink droplets each having a size less than the normal size.

Figure 6A:
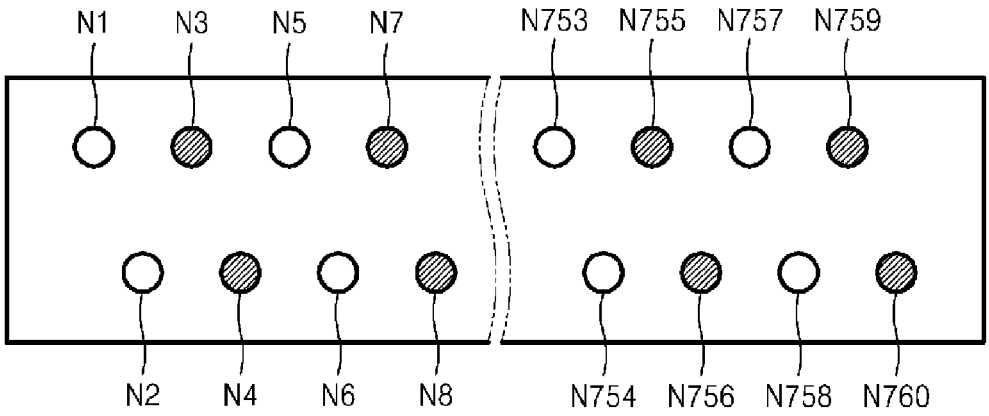
FIGS. 6A and 6B are schematic views for explaining a method of detecting a missing nozzle in a thermal inkjet printhead according to an embodiment of the present invention.
Figure 6B:
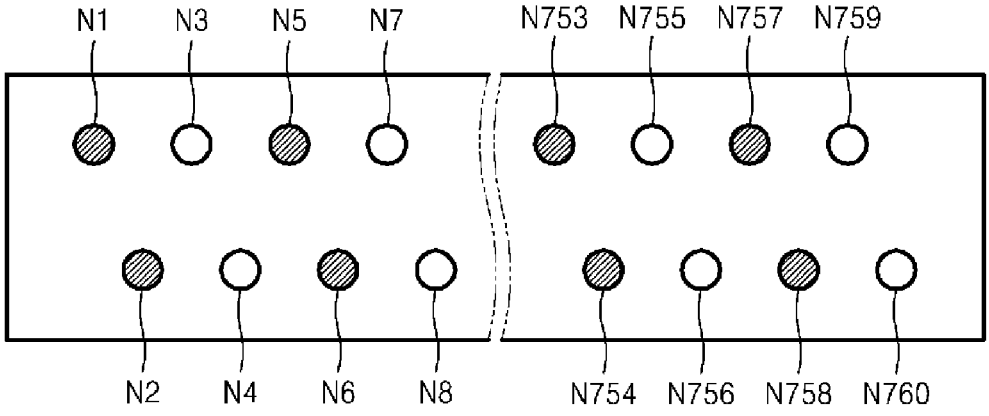

A method of detecting a missing nozzle among all nozzles of a thermal inkjet printhead will now be explained. FIGS. 6A and 6B are schematic views for explaining a method of detecting a missing nozzle among nozzles of a thermal inkjet printhead performed by using the apparatus of FIG. 1 according to another embodiment of the present invention. In FIGS. 6A and 6B, the inkjet printhead includes 760 nozzles N1 through N760 arranged in two rows.

Referring to FIG. 6A, adjacent first and second nozzles form one pair. For example, each of the adjacent nozzles N1 and N3, N2 and N4, N5 and N7, N6 and N8, . . . , N753 and N755, N754 and N756, B757 and N759, and N758 and N760 form one pair. The nozzles N1, N2, N5, N6, . . . , N753, N754, N757, N758 are first nozzles, and the nozzles N3, N4, N7, N8, . . . , N755, N756, N758, N760 are second nozzles. The first nozzles N1, N2, . . . , N757, N758 are set as target nozzles whose operations are to be measured, and the second nozzles N3, N4, . . . , N759, N760 respectively adjacent to the first nozzles are set as reference nozzles. Accordingly, a first input energy high enough to normally eject ink is applied to first heaters (not shown) corresponding to the first nozzles N1, N2, . . . , N757, N758, and a second input energy not high enough to eject ink is applied to second heaters (not shown) corresponding to the second nozzles N3, N4, . . . , N759, N760. The second input energy may be approximately 30% of the first input energy.

Next, when a predetermined time, e.g., 2 seconds, passes after ink ejection, a temperature difference or resistance difference between the first nozzles N1, N2, . . . , N757, N758, which are the target nozzles, and the second nozzles N3, N4, . . . , N759, N760, which are the reference nozzles, is measured by using the multiplexer 160 and the difference amplifier 170 of the apparatus of FIG. 1. Whether the first nozzles N1, N2, . . . , N757, N758 are missing is determined by using the measured temperature difference or resistance difference. Since a method of determining whether a nozzle is missing by using a temperature difference or resistance difference has already been explained in detail, a repeated explanation will not be given.

Next, the operation of the inkjet printhead is stopped for a predetermined period of time, e.g., 10 seconds, so that all the nozzles N1,N2,N3,N4, . . . ,757,758,759,760 of the inkjet printhead can reach initial temperatures.

In contrast to FIG. 6A, referring to FIG. 6B, the first nozzles N1, N2, . . . , N757, N758 are set as reference nozzles, and the second nozzles N3, N4, . . . , N759, N760 are set as target nozzles. Accordingly, the first input energy high enough to normally eject ink is applied to the second heaters corresponding to the second nozzles N3, N4, . . . , N759, N760, and the second input energy not high enough to eject ink is applied to the first heaters corresponding to the first nozzles N1, N2, . . . , N757, N758. Next, when a predetermined time, e.g., 2 seconds, passes after ink ejection, a temperature difference or resistance difference between the second nozzles N3, N4, . . . , N759, N760 which are the target nozzles and the first nozzles N1, N2, . . . , N757, N758 which are the reference nozzles is measured by using the multiplexer 160 and the differential amplifier 170. Whether the second nozzles N3, N4, . . . , N759, N760 are missing is determined by using the measured temperature difference or resistance difference. Accordingly, the method of FIGS. 6A and 6B can check all of the nozzles N1 through N760 of the inkjet printhead and detect whether there is a missing nozzle in the nozzles N1 through N760.

Figure 7:
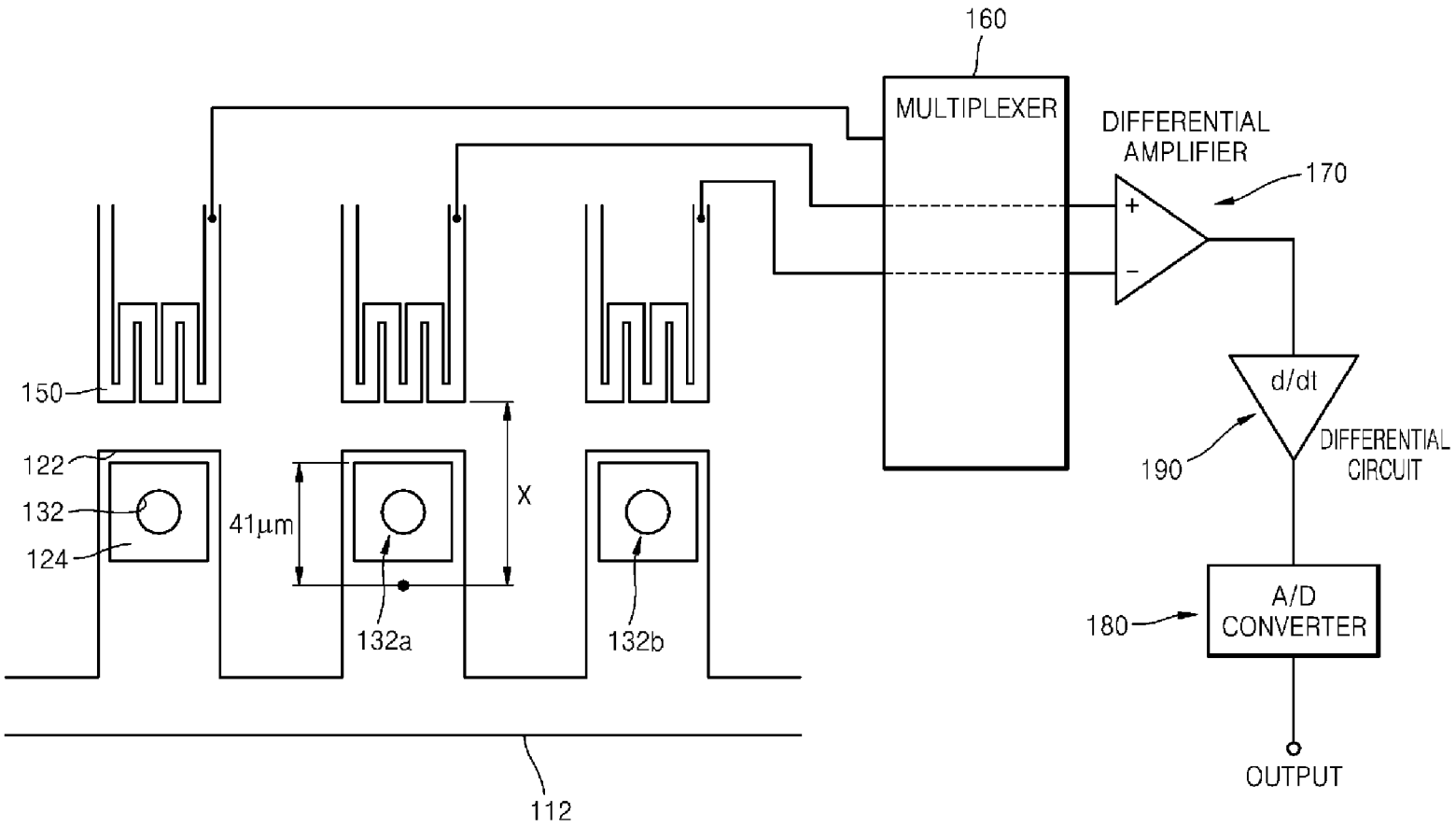
FIG. 7 is a schematic view of an apparatus for detecting a missing nozzle in a thermal inkjet printhead according to another embodiment of the present invention.

FIG. 7 is a schematic view of an apparatus for detecting a missing nozzle in an inkjet printhead according to another embodiment of the present invention. The apparatus of FIG. 7 is the same as the apparatus of FIG. 1 except that a differential circuit 190 is disposed between the differential amplifier 170 and the A/D converter 180. Referring to FIG. 7, a temperature difference between the target nozzle 132*a* and the reference nozzle 132*b* output from the differential amplifier 170 is input to the differential circuit 190. The differential circuit 190 differentiates the temperature difference with respect to time to obtain a temperature change rate and outputs the temperature change rate as will be described later.

Figure 8:
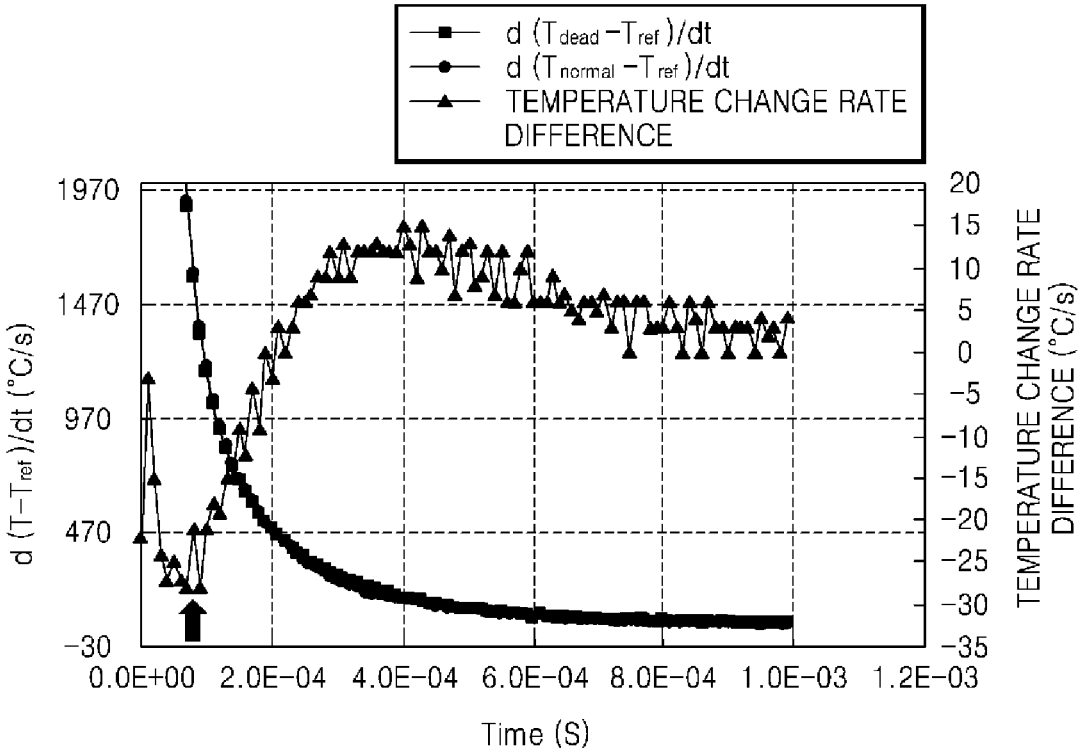
FIG. 8 is a graph illustrating a temperature change rate of a normal nozzle and a reference nozzle and a temperature change rate of a dead nozzle and a reference nozzle over time using the apparatus of FIG. 7.

FIG. 8 is a graph illustrating a temperature change rate of a normal nozzle and the reference nozzle 132*b* and a temperature change rate of a dead nozzle and the reference nozzle 132*b* over time when a measurement distance X is 100 μm using the apparatus of FIG. 7. A temperature change rate $d(T_{normal}-T_{ref})/dt$ of the normal nozzle and the reference nozzle 132*b* is obtained by differentiating a temperature difference between the normal nozzle and the reference nozzle 132*b* with respect to time, and a temperature change rate $d(T_{dead}-T_{ref})/dt$ of the dead nozzle and the reference nozzle 132*b* is obtained by differentiating a temperature difference between the dead nozzle and the reference nozzle 132*b* with respect to time. In FIG. 8, a temperature change rate difference $d(T_{dead}-T_{ref})/dt-d(T_{normal}-T_{ref})/dt$ marked by ▲ was obtained by subtracting the temperature change rate $d(T_{normal}-T_{ref})/dt$ of the normal nozzle and the reference nozzle 132*b* from the temperature change rate $d(T_{dead}-T_{ref})/dt$ of the dead nozzle and the reference nozzle 132*b*. Like in FIG. 5, an input energy applied to a heater 124 corresponding to the target nozzle 132*a* was 1.2 μJ and an ejection frequency was 6 kHz. An input energy applied to a heater 124 corresponding to the reference nozzle 132*b* was 30% of the input energy applied to the target nozzle 132*a*.

Referring to FIG. 8, when a measurement is performed at a time indicated by an arrow, that is, when performed 70 μs after ink ejection, a minimum temperature change rate difference $d(T_{dead}-T_{ref})/dt-d(T_{normal}-T_{ref})/dt$ is obtained. At this point of time, the temperature change rate $d(T_{normal}-T_{ref})/dt$ of the normal nozzle and the reference nozzle 132*b* is approximately 1922° C./s, and the temperature change rate $d(T_{dead}-T_{ref})/dt$ of the dead nozzle and the reference nozzle 132*b* is approximately 1894° C./s. Whether the target nozzle 132*a* is missing can be determined by calculating a temperature change rate $d(T-T_{ref})/dt$ of the target nozzle 132*a* and the reference nozzle 132*b* from the results. In detail, when the temperature change rate $d(T-T_{ref})/dt$ between the target nozzle 132*a* and the reference nozzle 132*b* calculated when 70 μs passes after ink ejection is greater than 1922° C./s, the target nozzle 132*a* is a normal nozzle, and when the temperature change rate $d(T-T_{ref})/dt$ of the target nozzle 132*a* and the reference nozzle 132*b* is less than 1894□/s, the target nozzle 132*a* is a dead nozzle.

As described above, the apparatus of FIG. 7 can determine whether the target nozzle 132*a* is missing by calculating a temperature change rate of the target nozzle 132*a* and the reference nozzle 132*b* by means of the differential circuit 190. The calculating of the temperature change rate can be performed shortly after ink ejection, for example, 70 μs after ink ejection, a method performed by using the apparatus of FIG. 7 according to the present invention can reduce a measurement time considerably.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of detecting a missing nozzle in a thermal inkjet printhead, the method comprising:

applying an input energy high enough to eject ink to a heater corresponding to a target nozzle, and applying an input energy not high enough to eject ink to a heater corresponding to a nozzle adjacent to the target nozzle;

when a predetermined time passes, detecting a difference between temperatures which are measured at points spaced by a predetermined distance from each of the two heaters; and determining whether the target nozzle is missing.

2. The method of claim 1, wherein whether the target nozzle is missing is determined by using the detected temperature difference.

3. The method of claim 1, wherein whether target nozzle is missing is determined by using a temperature change rate difference calculated by using the detected temperature difference.

4. A method of detecting a missing nozzle in a thermal inkjet printhead, the method comprising:

selecting first and second heaters adjacent to each other among heaters of the inkjet printhead;

applying a first input energy high enough to eject ink to the first heater and applying a second input energy not high enough to eject ink to the second heater;

when a predetermined time passes, detecting a difference between temperatures which are measured at points spaced by a predetermined distance from each of the first and second heaters; and determining whether the first heater is missing.

5. The method of claim 4, wherein the second input energy is approximately 30% of the first input energy.

6. The method of claim 4, wherein whether the first heater is missing is determined by using the detected temperature difference.

7. The method of claim 4, wherein whether the first heater is missing is determined by using a temperature change rate difference calculated by using the detected temperature difference.

8. The method of claim 4, when a predetermined time passes after the determining of whether the first heater is missing, the method further comprising:

applying the second input energy to the first heater and applying the first input energy to the second heater;

when a predetermined time passes, detecting a difference between temperatures which are measured at points spaced by a predetermined distance from each of the first and second heaters; and determining whether the second heater is missing.

* * * * *